US005108803A

United States Patent [19]

Kondo et al.

[11] Patent Number: 5,108,803

[45] Date of Patent: Apr. 28, 1992

[54] THERMALLY SHRINKABLE FILM HAVING A LIQUID DETECTING FUNCTION AND A PACKAGE USING THE SAME

[75] Inventors: Kazuo Kondo; Nobuya Ishiguro; Teruo Tada, all of Marugame, Japan

[73] Assignee: Okura Industrial Co., Ltd., Kagawa, Japan

[21] Appl. No.: 532,147

[22] Filed: Jun. 1, 1990

Related U.S. Application Data

[63] Continuation of Ser. No. 276,588, Nov. 28, 1988, abandoned.

[30] Foreign Application Priority Data

Nov. 30, 1987 [JP] Japan ..... 62-183097[U]
Dec. 8, 1987 [JP] Japan ..... 62-187453[U]

[51] Int. Cl.[5] ..... B65D 65/46

[52] U.S. Cl. ..... 428/34.2; 206/459; 206/497; 206/807; 428/35.1; 428/199; 428/916

[58] Field of Search ..... 206/459, 497, 807; 428/199, 204, 916, 35.1, 34.9, 34.2

[56] References Cited

U.S. PATENT DOCUMENTS

| | | | |
|---|---|---|---|
| 4,449,631 | 5/1984 | Levenberg et al. | 206/459 |
| 4,505,218 | 3/1985 | Fiarman et al. | 206/497 |
| 4,516,679 | 5/1985 | Simpson et al. | 428/916 |
| 4,546,881 | 10/1985 | Tasma | 206/459 |
| 4,718,553 | 1/1988 | Adamoli et al. | 206/459 |
| 4,755,405 | 7/1988 | Massucco et al. | 428/916 |
| 4,816,305 | 3/1989 | Stillwell et al. | 428/35.7 |

*Primary Examiner*—James J. Seidleck
*Attorney, Agent, or Firm*—Armstrong, Nikaido, Marmelstein, Kubovcik & Murray

[57] ABSTRACT

A thermally shrinkable film with a liquid detecting function is prepared by coating or printing one side of the film with an ink which turns color or dissolves upon contact with a liquid. An item or object to be packaged is packaged in a thermally shrinkable film. The thermally shrinkable film and the package are useful for detecting a liquid leaking from the packed item or object, or entering into the package from the outside. This permits a visual inspection of the quality of the item or object packaged therein or of contamination by a foreign substance.

3 Claims, No Drawings

THERMALLY SHRINKABLE FILM HAVING A LIQUID DETECTING FUNCTION AND A PACKAGE USING THE SAME

This application is a continuation of application Ser. No. 276,588 filed Nov. 28, 1988 now abandoned.

BACKGROUND OF THE INVENTION

The present invention relates to a thermally shrinkable film having a liquid detecting function and a package using the same and, more particularly, to a thermally shrinkable film with a liquid detecting function and a package of an item or object or of a container filled with a liquid or packaged dry material. The thermally shrinkable film is adapted for use with a paper pack container or a plastic container in which a liquid material is to be filled, or with a glass container and the like in which an individual item is bundled or plural items are to be bundled, wrapped or packed. The thermally shrinkable film is particularly useful for thermoshrinkably bundling, wrapping or packing an items or objects containing a liquid, such as pickles or other goods, which in turn are bundled, wrapped or packed in a plastic container. The thermally shrinkable film is also useful for bundling, wrapping or packing an item or object necessary to be held in a dry state, such as dry foodstuff.

Furthermore, in accordance with the present invention, the package comprises an item or object to be packed or a container with the item or object packaged therein and the thermally shrinked film can be used for the purpose of detecting a liquid leaking from the packed item or object or the container or a liquid entering into the packed item or object through the thermally shrunk film. This liquid detecting function permits ensuring the integrity of items or objects such as juices, milk, coffee, bean milk, tea and the like, in vacuum packed paper pack containers and other containers. The thermoshrinkable film and the package according to the present invention also confirm a the extent of dryness of dry items or objects in containers and will identify the penetration of any liquid therethrough into containers from the outside.

Heretofore, when an item or object or a container with the item or object packed is thermoshrinkably packaged with a conventional thermally shrinkable film, leakage of a liquid and entry thereof can be easily detected if a considerably large amount of a liquid from a packaged material or a package or penetrates to the inside of the packaged material. However, it has been extremely difficult or even impossible to detect the leakage of a small amount of a liquid from a container using a conventional thermoshrinkable film or the penetration of a small amount of liquid through the package. This situation is all the more difficult if a liquid is colorless or transparent.

Furthermore, in instances where paper pack containers in which foodstuff and other items are packed by vacuum packaging are further packed thermoshrinkably by a conventional thermoshrinkable plastic film, it is virtually impossible for consumers and sellers to check whether the containers are held in a substantially vacuum state before opening the containers. Even if a small hole exists in a container through which air may penetrate into the container and the contents in the container would decay or rot, or even if a poisonous or hazardous substance is intentionally inserted, using an injector's needle, through the container, such a small amount of a foreign substance could not be detected.

On top of that, in the case of dry items or objects packed in a conventional thermoshrinkable film, it has been practially impossible for consumers and sellers to check before opening whether the dry items have been maintained in a sufficient degree of dryness while being packed in a container.

SUMMARY OF THE INVENTION

Therefore, the present invention relates to a thermally shrinkable film with a liquid detecting function capable of detecting leakage of a small amount of a liquid outside of a packaged item or object which has been thermoshrinkably packed in a container or penetration of a small amount of a liquid into the container and to provide a package with such a liquid detecting function, which comprises an item or object to be packed or a container with the item or object packed and the thermally shrunk film having a liquid detecting function which thermoshrinkably packages the item or object or the container in a thermoshrinkable manner.

In accordance with the present invention the package prepared by thermoshrinkably packaging an item or object or the container containing the item or object by the thermally shrinkable film, such as paper pack, plastic or glass containers, is designed so as to permit observance of the integrity or injury on or in the package or the container and to confirm whether the item or object or the container is held in a thoroughly closed state. It is also designed to observe that package contents are not caused to decay or rot due to air penetrating through a hole of the package. Furthermore, the package according to the present invention allows the detection of the presence of a foreign material such as a poisonous substance even if such a poisonous substance could be injected to the inside of a package by a needle or the like, because the package is designed to detect a liquid leaking outside from the container through a hole through which the needle has been injected.

The package according to the present invention is further designed so as to detect a small amount of a liquid leaking from a plastic film bag in a corrugated cardboard box or the like even in instances where a number of plastic film bags in which an item or object containing a liquid therein have been filled in a closed state are packed in a thermally shrinked manner. Accordingly, even if there is one plastic film bag from which the liquid of the item or object has leaked. The package can detect the presence of such a bag and furthermore check that the container is held in a substantially closed state and the bag is damaged at all.

In thermoshrinkably packaging a dry item or object with the thermoshrinkable film according to the present invention, the package is furthermore designed so as to detect the presence of an insufficiently dry item or object or of such an item or object from which a small amount of a liquid leaks. The thermally shrinkable film and the package according to the present invention are particularly useful from a safety point of view because they can provide consumers and sellers with an indication of a presence of such a damaged packaged material.

In one aspect the present invention consists of a thermally shrinkable film having a liquid detecting function comprising one side of the thermally shrinkable film with an ink coated thereon or with a design or pattern printed thereon by ink; the ink turning its color or which dissolves and flows away upon contact with a liquid leaking from the item or object or entered into the thermally shrinked film.

In another aspect the present invention consists of a package having a liquid detecting function, which is obtained by thermoshrinkably packaging the item or object or the container with the item or object packed therein by the thermally shrinkable film according to the present invention.

Other objects, features and advantages of the present invention will become apparent in the course of the following description of the preferred embodiments.

DETAILED DESCRIPTION OF THE PREFERRED EMBODIMENTS

The thermally shrinkable film according to the present invention is designed such that one side of the thermally shrinkable film is coated with an ink or a design printed on one side thereof with such an ink so as to become discolored or turning its color or as becoming dissolved in a liquid and flowing away, upon contact with the liquid.

In accordance with the present invention, the thermally shrinkable film is coated partially or wholly on one side with an ink which becomes discolored or turns color upon contact with a liquid which leaks outside of the thermally shrunk film or which penetrates inside through the thermally shrunk film or the package obtained using the same. The thermally shrinkable film may be partially or wholly printed on one side with a design or pattern using the ink.

Accordingly, the package according to the present invention is provided, as a matter of course, with the liquid detecting function because it is prepared by thermoshrinkably packaging the item or object or the container with the thermally shrinkable film that is coated or printed partially or wholly on its one side with the ink in such a manner as being capable of detecting a liquid leaking from or penetrating the thermoshrinkable film.

Accordingly, the thermoshrinkable packaging of an item or object or a container with the item or object packed therein with the thermally shrinkable film permits a detection of leakage of a liquid from the item or object or the container outside the item or object or the container or penetration of a liquid from outside the package or into the package by changing the color or the regularity of a color coated on the thermally shrinkable film or by changing or transforming a design or pattern printed thereon.

The ink to be used in accordance with the present invention may be any ink that may turn color or become discolored or be dissolved in a liquid upon contact with liquid leaking from a packaged item or object or from a container containing the item or object or a liquid entering into the package consisting of the item or object or the container and the thermoshrinked film. The ink to be used for the invention may be any one which turns color or becomes discolored upon contact with a liquid such as water, a liquid containing sugar or salt, or an acidic or alkaline solution. The ink may be transparent and colorless or colored. The ink capable of being dissolved in the liquid may be a water-base ink and the like. The ink used in the invention should be colored, and it may be pale in color and transparent.

Portions of the thermally shrinkable films having inks described hereinabove turn color upon contact with a very small amount of the liquid. A design or pattern printed thereon with the ink of the latter type is transformed or fades away upon contact with a very small amount of the liquid.

The thermally shrinkable film according to the present invention may include, for example, a mono-layer film consisting of a vinyl chloride resin, a polypropylene resin or the like, or a multi-layer film having various characteristics such as a resinous layer having a gas barrier laminate as a middle layer.

The thermally shrinkable film with the liquid detection function according to the present invention may be coated partially or wholly on its one side with the ink. Furthermore, a design or pattern may be printed partially or wholly on its one side with the ink in order to enhance a display effect. In instances where a point-of-sales (POS) code system is printed as a design or pattern on the thermally shrinkable film according to the present invention, the presence of a liquid from the packaged item or object or the container with the item or object packed therein or the penetration of a liquid into the package packaged thermoshrinkably, using the thermally shrinkable film, can be detected by transformation in shapes of the design or pattern or disappearance of the design or pattern, thus enabling consumers to easily determine the quality of goods in the package at the time of purchase and such an invention allows sellers to readily check and remove damaged goods before sale.

The package according to the present invention may be prepared in a thermoshrinkable manner by conventional thermoshrinkable methods as conventionally applied to a thermally shrinkable film and the like of polypropylene type or of polyethylene type or the like. Furthermore, a vacuum thermoshrinkable packaging method conventionally applicable to a thermoshrinkable film with a gas barrier property may also be used for the thermoshrinkable packaging of the item or object or of the container.

It is a matter of course that the thermally shrinkable film on which the ink is coated or the design is printed on should thermoshrinkably package an item or object or a container with the item or object in such a manner as being brought into contact with the item or object or with the container. It is preferred that the coated or printed side of the thermally shrinkable film is located at a side or at a bottom of the packaged item or object or of the container, thus allowing the leaking liquid to drain down along the side of the packaged item or object or of the container to the bottom of the package. This permits an easy detection of liquid leaking from the packaged item or object or of the container.

In accordance with the present invention, the package prepared by thermoshrinking the thermally shrinkable film is such that a packaged item or object, or a container with the item or object packed, is thermoshrinkably packaged by the thermally shrinkable film in such a manner so that the two are in tight contact with each other. Accordingly, the package according to the present invention permits a ready detection of a change in color of the ink or the transformation of a design precipitated by the leakage of or entry of a very small amount of a liquid from or into the package. Thus, in the event where it is found visibly difficult to observe a change by external appearances of the package even if there has been liquid leakage or liquid entry and if the contents are decayed, contaminated or infected, an application of pressure on the package, by grasping the package strongly, can squeeze a small amount of the liquid from the package through a damaged portion of the package or a small hole created by needle puncture when such is used to tamper with the package, the squeezed liquid changes the color or design on the inner side of the thermally shrunk film of the package. Shaking the package in every direction may also help to detect a damaged portion or a small hole when it is formed on a portion or a side with which a liquid, if leaking does not come in contact originally with the ink.

The thermally shrinkable film having the liquid detecting function has various advantages because it enables a small amount of a liquid leaking from an item or object, to be packaged or entered into the package, to be detected readily. Accordingly, when the thermally shrinkable film is used for thermoshrinkably packaging a paper pack container or containers with the packing item or object packed by vacuum packaging into the package, a presence or absence of a damaged portion of the package or a closed state of the package can be readily checked. The package according to the present invention permits confirmation of package integrity in an easy manner. The thermoshrinkable packaging of a cardboard box in which a number of plastic film bags or the like containing an item or object with a liquid is packaged assures that no leakage of the liquid from the plastic film bags has occured even if the cardboard box is opened. When a dry item or object is packaged thermoshrinkably using the thermally shrinkable film according to the present invention, the extent of dryness of the dry item or object can be ensured.

Thus, the thermally shrinkable film and the package according to the present invention ensure a high degree of safety to and a high quality of the item or object thermoshrinkably packaged by the thermally shrinkable film and in the package.

The present invention will be described more in detail by the following examples.

EXAMPLE 1

A thermally shrinkable polypropylene film with a thickness of 20 microns processed by the corona surface treatment was uniformly coated on one whole surface with a small amount of a transparent blue water-base paint (trade name: XOW-1256; manufacturer: Dainippon Ink & Chemicals, Inc.) by means of the letterpress printing, and the coat was blown dry with air at ambient temperature.

The ink coated on the resulting film was found running leading to disarray upon contact with small waterdrops. This permits a ready and quick detection of the waterdrops adhered on the film, whereby the thermally shrinkable film was found capable of detecting a liquid.

EXAMPLE 2

Using the thermally shrinkable film, a paper pack container with a vacuum packed milk product was packaged by means of a thermoshrinkable packaging line conventionally used for a theremoshrinkable polypropylene film, yielding a package having a liquid detecting function.

As a needle was inserted into the thermoshrinked paper pack container, a small amount of the lactic beverage was squeezed through a small hole from the thermoshrinked film, leaving a scar of the running liquid on the package. This judges at glance the presence of a hole in the package through which the content or a liquid has squeezed.

EXAMPLE 3

A POS (point-of-sales) mark was printed on one side of a thermoshrinkable nylon/polyethylene laminate film in a thickness of 40 microns with a black water-base ink (trade name: XOW-1218AE; manufacturer: Dainippon Ink & Chemicals, Inc.), yielding a thermally shrinkable film with a liquid detecting function.

Using the thermally shrinkable film, a cardboard box with a number of plastic bags in which horse radish pickles were packed was packaged thermoshrinkably, and one packed plastic bag was included which has been slightly damaged for experimental purpose.

A liquid squeezed from the damaged plastic bag ran down to the POS mark on an inner side of the thermoshrinked film, thus disfiguring the POS mark so that a price indicated by the POS mark could not be read.

What is claimed is:

1. A package comprising a paper pack container containing a vacuum packed liquid which is enclosed by a thermally shrinked film, said thermally shrinked film having a liquid detection function wherein a side of the thermally shrinked film is at least partially coated or printed with an ink, said ink turning color or dissolving upon contact with said liquid, and wherein the side of said thermally shrinked film coated or printed with said ink faces said paper packed container.

2. The package of claim 1, wherein a design is printed with said ink.

3. The package of claim 2, wherein the design is a point-of-sales mark.

* * * * *